US007022662B2

(12) United States Patent
Kischkel et al.

(10) Patent No.: US 7,022,662 B2
(45) **Date of Patent: *Apr. 4, 2006**

(54) COMPOSITIONS CONTAINING HYDROXY MIXED ETHERS AND POLYMERS

(75) Inventors: Ditmar Kischkel, Monheim (DE); Manfred Weuthen, Langenfeld (DE); Michael Elsner, Heiligenhaus (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 12 days.

This patent is subject to a terminal disclaimer.

(21) Appl. No.: 10/288,644

(22) Filed: Nov. 4, 2002

(65) Prior Publication Data

US 2003/0153481 A1 Aug. 14, 2003

(30) Foreign Application Priority Data

Nov. 2, 2001 (DE) ..... 101 53 768

(51) Int. Cl.
*C11D 1/38* (2006.01)
*C11D 3/37* (2006.01)
*C11D 11/00* (2006.01)

(52) U.S. Cl. ..... 510/475; 510/238; 510/239; 510/240; 510/356; 510/360; 510/421; 510/422; 510/426; 510/470; 510/499; 510/504; 510/505; 510/506

(58) Field of Classification Search ..... 510/238–240, 510/356, 360, 421, 422, 426, 470, 475, 499, 510/504, 505, 506
See application file for complete search history.

(56) References Cited

U.S. PATENT DOCUMENTS

| | | | | |
|---|---|---|---|---|
| 4,172,887 | A | 10/1979 | Vanlerberghe et al. | |
| 5,312,932 | A | 5/1994 | Behler et al. | |
| 5,322,957 | A | 6/1994 | Fabry et al. | |
| 5,484,531 | A | 1/1996 | Kuehne et al. | |
| 5,759,987 | A | 6/1998 | Haerer et al. | |
| 6,530,383 | B1 * | 3/2003 | Rogmann et al. | 134/25.2 |
| 2003/0153481 | A1 * | 8/2003 | Kischkel et al. | 510/421 |
| 2003/0171243 | A1 * | 9/2003 | Kischkel et al. | 510/421 |

FOREIGN PATENT DOCUMENTS

| | | | |
|---|---|---|---|
| DE | 24 32 757 | A1 | 1/1976 |
| DE | 2432757 | * | 1/1976 |
| DE | 42 04 700 | A1 | 8/1993 |
| DE | 43 23 252 | C2 | 1/1995 |
| DE | 197 38 866 | A1 | 3/1999 |
| DE | 19738866 | * | 3/1999 |
| EP | 0 561 825 | B1 | 9/1993 |
| EP | 0 561 999 | B1 | 9/1993 |
| FR | 2 252 840 | A | 8/1975 |
| WO | WO 00/46327 | * | 8/2000 |
| WO | WO 01/55285 | * | 8/2001 |
| WO | WO 01/55288 | * | 8/2001 |
| WO | WO 01/55289 | * | 8/2001 |

OTHER PUBLICATIONS

R. Lochhead et al., "Encyclopedia of Polymers and Thickeners for Cosmetics", Cosmetics & Toiletries, vol. 108, (May, 1993), pp. 95-114, 116-124, 127-130, 132-135.
Biermann, et al., "Alkylpolyglucoside—Technologie und Eigenschaften", Starch/Stärke, vol. 45, VCH Verlagsgesellschaft mbH, Weinheim, (1993), pp. 281-288, Not Translated ; no month given.
Salka, "Alkyl Polyglycoside Properties and Applications", Cosmetics & Toiletries, vol. 108, (Mar., 1993), pp. 89-94.
Kahre, et al, "Alkylpolyglycoside—Ein neues Konzept für Pflege und Verträglichkeit in der Kosmetik", SÖFW-Journal, vol. 121, No. 8, (1995), pp. 598, 600-601, 604-611, Not Translated ; no month given.
Biswas, et al., "Surface-Active Properties of Sodium Salts of Sulfated Fatty Acid Monoglycerides", The Journal Of The American Oil Chemists' Society, vol. 37, (Apr., 1960), pp. 171-175.
Ahmed, "Efficient Synthesis of Fatty Monoglyceride Sulfates from Fatty Acids and Fatty Acid Methyl Esters", JAOCS, vol. 67, No. 1, (Jan., 1990), pp. 8-14.

* cited by examiner

*Primary Examiner*—Brian P. Mruk
(74) *Attorney, Agent, or Firm*—John F. Daniels; Daniel S. Ortiz

(57) ABSTRACT

The invention relates to surfactant mixtures of hydroxy mixed ethers and polymers, optionally together with typical ingredients of dishwashing detergents and cleaners and optionally other nonionic surfactants and anionic surfactants and to the use of such surfactant mixtures for the preparation of cleaning solutions with improved performance against resoiling.

17 Claims, No Drawings

COMPOSITIONS CONTAINING HYDROXY MIXED ETHERS AND POLYMERS

BACKGROUND OF THE INVENTION

Compositions for the washing and cleaning of hard non-textile surfaces occurring in the home and in the institutional sector are generally intended to generate little foam in use, the foam they do generate being expected to collapse significantly in a few minutes. Compositions of this type are well-known and established on the market. They are essentially aqueous surfactant solutions of various kinds with and without added builders, solubilizers (hydrotropes) or solvents. Although the consumer prefers the in-use solution to foam to a certain extent at the beginning of the cleaning task as proof of effectiveness, the foam is expected to collapse rapidly so that cleaned surfaces do not have to be rewiped. To this end, low-foaming nonionic surfactants are normally added to compositions of the type mentioned.

Today, machine-washed tableware has to meet stricter requirements than hand-washed tableware. Thus, even tableware completely free from food residues is regarded as unsatisfactory when, after dishwashing, it still has whitish stains which are attributable to water hardness or other mineral salts and which come from water droplets that have remained on the tableware through lack of wetting agent and dried.

Accordingly, to obtain bright, spotless tableware, rinse agents have to be used. The addition of liquid or solid rinse agent—which may be separately added or which is already present in ready-to-use form together with the detergent and/or regenerating salt ("2-in-1", "3-in-1", for example in the form of tablets and powders)—ensures that the water drains completely from the tableware so that the various surfaces are bright and free from residues at the end of the dishwashing program. Commercially available rinse agents are mixtures of, for example, nonionic surfactants, solubilizers, organic acids and solvents, water and optionally preservative and perfumes.

The function of the surfactants in these compositions is to influence the interfacial tension of the water in such a way that it is able to drain from the tableware as a thin, coherent film so that no droplets of water, streaks or films remain behind during the subsequent drying process (so-called wetting effect). Accordingly, another function of surfactants in rinse agents is to suppress the foam generated by food residues in the dishwashing machine. Since the rinse agents generally contain acids to improve the clear drying effect, the surfactants used also have to be relatively hydrolysis-resistant towards acids.

Rinse agents are used both in the home and in the institutional sector. In domestic dishwashers, the rinse agent is added after the prerinse and wash cycle at 40 to 65° C. Institutional dishwashers use only one wash liquor which is merely replenished by addition of the rinse agent solution from the preceding wash cycle. Accordingly, there is no complete replacement of water in the entire dishwashing program. Because of this, the rinse agent is also expected to have a foam-suppressing effect, to be temperature-stable in the event of a marked drop in temperature from 85 to 35° C. and, in addition, to be satisfactorily resistant to alkali and active chlorine.

In addition, it should be possible through the use of rinse agents to finish the surfaces to be cleaned in such a way that soil is easier to remove in the next dishwashing cycle.

DE-A1 19738866 describes surfactant mixtures of hydroxy mixed ethers and nonionic surfactants, such as optionally end-capped fatty alcohol polyethylene glycol/polypropylene glycol ethers, which have favorable foaming behavior and show good clear rinse effects in rinse agents. It is known from German Offenlegungsschrift DE-OS 2432757 that hydroxy mixed ethers can be used as foam suppressors in laundry detergents, dishwashing detergents and cleaning compositions.

The problem addressed by the present invention was to provide surfactant mixtures for the production of dishwashing detergents and cleaners which, at one and the same time, would show good foaming and cleaning behavior, but especially favorable drainage behavior, through improved wetting behavior on various surfaces. The cleaned surfaces would thus create a particularly good visual impression distinguished by greater sparkle. In addition, high material compatibility, particularly with plastics, would be guaranteed and solid cleaning formulations would be easier to produce. Also, the surfaces to be cleaned or rinsed would be left with such a finish that soil would be easier to remove in the next cleaning cycle.

The problem stated above has been solved by the combination according to the invention of hydroxy mixed ethers and polymers in the mixing ratio according to the invention. A spotless shine of the surfaces to be cleaned is obtained through the very favorable wettability. The effect of adding polymers to rinse agents is that otherwise firmly adhering and often critical soils, for example starch-containing soils, can be completely removed in the next cleaning cycle. These soils can be removed without additional manual treatment of the tableware.

SUMMARY OF THE INVENTION

This invention relates to surfactant mixtures of hydroxy mixed ethers and polymers, optionally together with typical ingredients of dishwashing detergents and cleaners and optionally other nonionic surfactants and anionic surfactants and to the use of such surfactant mixtures for the preparation of cleaning solutions with improved performance against resoiling.

The present invention relates to surfactant mixtures containing: (a) hydroxy mixed ethers corresponding to formula (I):

$$\underset{R^3}{R^1O[CH_2CH(CH_3)O]_x[CH_2CH(R^2)O]_y}CH_2CH(OH) \qquad (I)$$

in which $R^1$ is a linear or branched alkyl and/or alkenyl group containing 4 to 22 carbon atoms, $R^2$ is hydrogen or a methyl or ethyl group, $R^3$ is an alkyl group containing 4 to 22 carbon atoms, x=0 or 1 to 60, y=1 to 80 and the alkylene units may be present both in blocked and in randomized form, and (b) polymers.

DETAILED DESCRIPTION OF THE INVENTION

Hydroxy Mixed Ethers

Hydroxy mixed ethers corresponding to formula (I) are normally prepared by reaction of 1,2-epoxyalkanes ($R^3CHOCH_2$), where $R^3$ is an alkyl and/or alkenyl group containing 4 to 22 and more particularly 6 to 16 carbon atoms, with alkoxylated alcohols. Hydroxy mixed ethers preferred for the purposes of the invention are those derived from alkoxylates of monohydric alcohols with the formula $R^1$—OH, $R^1$ being an aliphatic, saturated, linear or branched alkyl group containing 4 to 22, preferably 6 to 16 and more particularly 8 to 10 carbon atoms. Examples of suitable straight-chain alcohols are butan-1-ol, caproic alcohol, oenanthic alcohol, caprylic alcohol, pelargonic alcohol, capric alcohol, undecan-1-ol, lauryl alcohol, tridecan-1-ol, myristyl alcohol, pentadecan-1-ol, palmityl alcohol, heptadecan-1-ol, stearyl alcohol, nonadecan-1-ol, arachidyl alcohol, heneicosan-1-ol, behenyl alcohol and the technical mixtures thereof obtained in the high-pressure hydrogenation of technical methyl esters based on fats and oils. Examples of branched alcohols are so-called oxo alcohols which generally contain 2 to 4 methyl groups as branches and are produced by the oxo process and so-called Guerbet alcohols which are branched in the 2-position by an alkyl group. Suitable Guerbet alcohols are 2-ethyl hexanol, 2-butyl octanol, 2-hexyl decanol and/or 2-octyl dodecanol. The alcohols are used in the form of their alkoxylates which are prepared in known manner by reaction of the alcohols in any order (randomized, statistically distributed by preliminary mixing of the alkoxylating agents) with ethylene oxide and/or propylene oxide and/or butylene oxide or by block reaction with the alkylene oxides in a certain order (blocked). Alkoxylates of alcohols formed by reaction with 0 or 1 to 60 mol propylene oxide (x=0, 1–60) and 1 to 80 mol (y=1–80) ethylene oxide, propylene oxide and/or butylene oxide ($R^2$=hydrogen, methyl, ethyl) are preferably used. Hydroxy mixed ethers which have proved to be particularly suitable performance-wise in the surfactant mixtures correspond to formula (I) in which x=0 and y=1 to 80, preferably 20 to 60 and more particularly 35 to 50.

In one particular embodiment, suitable surfactant mixtures are those which contain hydroxy mixed ethers where x=0 and y=20 to 60 and preferably 35 to 50.

Particularly preferred surfactant mixtures contain hydroxy mixed ethers where $R^1$ is a linear or branched alkyl and/or alkenyl group containing 8 to 10 carbon atoms, $R^3$ is a linear or branched alkyl group containing 8 to 10 carbon atoms and y is a number of 20 to 60 and preferably 35 to 50. Another embodiment relates to hydroxy mixed ethers where $R^1$ is a linear alkyl group containing 4 to 22 and preferably 8 to 10 carbon atoms and $R^3$ is a linear alkyl group containing 8 to 12 carbon atoms. Ethoxylated ($R^2$=H) hydroxy mixed ethers (x=0) where y=2 to 40 are most particularly preferred. However, ethoxylated ($R^2$=H) hydroxy mixed ethers derived from an oxo alcohol, i.e. $R^1$ is a branched $C_{8-16}$ alkyl group and y=40 to 60, are also preferred.

Polymers

Suitable cationic polymers are, for example, cationic cellulose derivatives such as, for example, the quaternized hydroxyethyl cellulose obtainable from Amerchol under the name of Polymer JR 400®, cationic starch, copolymers of diallyl ammonium salts and acrylamides, quaternized vinyl pyrrolidone/vinyl imidazole polymers such as, for example, Luviquat® (BASF), condensation products of polyglycols and amines, quaternized collagen polypeptides such as, for example, Lauryldimonium Hydroxypropyl Hydrolyzed Collagen (Lamequat® L, Grüinau), quaternized wheat polypeptides, polyethyleneimine, cationic silicone polymers such as, for example, amodimethicone, copolymers of adipic acid and dimethylaminohydroxypropyl diethylenetriamine (Cartaretine®, Sandoz), copolymers of acrylic acid with dimethyl diallyl ammonium chloride (Merquat® 550, Chemviron), polyaminopolyamides as described, for example, in FR 2 252 840 A and crosslinked water-soluble polymers thereof, cationic chitin derivatives such as, for example, quaternized chitosan, optionally in microcrystalline distribution, condensation products of dihaloalkyls, for example dibromobutane, with bis-dialkylamines, for example bis-dimethylamino-1, 3-propane, cationic guar gum such as, for example, Jaguar®CBS, Jaguar®C-17, Jaguar®C-16 of Celanese, quaternized ammonium salt polymers such as, for example, Mirapol® A-15, Mirapol® AD-1, Mirapol® AZ-1 of Miranol.

Anionic, zwitterionic, amphoteric and nonionic polymers may also be used. Suitable anionic, zwitterionic, amphoteric and nonionic polymers are, for example, vinyl acetate/crotonic acid copolymers, vinyl pyrrolidone/vinyl acrylate copolymers, vinyl acetate/butyl maleate/isobornyl acrylate copolymers, methyl vinylether/maleic anhydride copolymers and esters thereof, uncrosslinked and polyol-crosslinked polyacrylic acids, acrylamidopropyl trimethylammonium chloride/acrylate copolymers, octylacrylamide/methyl methacrylate/tert.-butylaminoethyl methacrylate/2-hydroxypropyl methacrylate copolymers, polyvinyl pyrrolidone, vinyl pyrrolidone/vinyl acetate copolymers, vinyl pyrrolidone/dimethylaminoethyl methacrylate/vinyl caprolactam terpolymers and optionally derivatized cellulose ethers and silicones. Other suitable polymers are mentioned in Cosm. Toil. 108, 95 (1993). In one embodiment of the invention, the surfactant mixtures contain cationic polymers which have monomer units corresponding to formula (Ia):

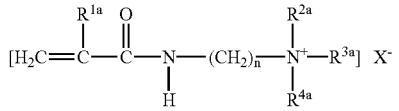

(Ia)

where n is a number of 2 to 4, preferably 3, $R^{1a}$ is hydrogen or a methyl group and $R^{2a}$, $R^{3a}$ and $R^{4a}$ may be the same or different and represent hydrogen or a $C_{1-4}$ alk(en)yl group, $X^-$ is an anion from the group of halide anions or a monoalkyl anion of sulfuric acid semiester. The polymers contain the monomer units of formula (Ia) in a quantity of preferably 10 mol-% to 80 mol-% and more particularly 20 mol-% to 60 mol-%. The polymers thus have a significant soil release effect. Besides the monomer units corresponding to formula (Ia), unsaturated monocarboxylic acids, such as acrylic acid, methacrylic acid, crotonic acid and the like, olefins, such as ethylene, propylene and butene, alkylesters of unsaturated carboxylic acids, more particularly esters of acrylic acid and methacrylic acid of which the alcohol components contain $C_{1-6}$ alkyl groups, such as methyl acrylate, ethyl acrylate, methyl methacrylate and hydroxy derivatives thereof, such as 2-hydroxyethyl methacrylate, aromatic compounds containing unsaturated groups and optionally other substituents, such as styrene, methylstyrene, vinylstyrene, and heterocyclic compounds, such as vinyl pyrrolidone, may be used as comonomers. Acrylic acid, methacrylic acid and $C_{1-6}$ esters thereof are preferably used as comonomers.

Other preferred surfactant mixtures contain polymers selected from the group consisting of polymers or copolymers of monomers such as trialkylammonium alkyl (meth) acrylate or acrylamide, dialkyldiallyl diammonium salts, polymer analog reaction products of ethers or esters of polysaccharides containing ammonium side groups, guar, cellulose and starch derivatives, polyadducts of ethylene oxide with ammonium groups, polyesters and polyamides containing quaternary side groups. It is particularly preferred to use polyacrylic acid copolymers, for example Versicol E11® or Glascol E11® (Allied Colloids), polyacrylamidopropanesulfonic acid, for example Rheothik 80-11® (Cognis), trimethyl ammonium propyl methacrylamide sodium acrylate/ethyl acrylate polymer, for example Polyquart Ampho 149® (Cognis). Quaternized protein hydrolyzates, for example Gluadin WQ® (Cognis), are also preferred.

It is also preferred to use soil repellents. Suitable soil repellents are substances which preferably contain ethylene terephthalate and/or polyethylene glycol terephthalate groups, the molar ratio of ethylene terephthalate to polyethylene glycol terephthalate being in the range from 50:50 to 90:10. The molecular weight of the linking polyethylene glycol units is more particularly in the range from 750 to 5,000, i.e. the degree of ethoxylation of the polymers containing polyethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000. Examples of commercially available polymers are the products Milease® T (ICI) or Repelotex® SRP 3 (Rhône-Poulenc).

In another preferred embodiment, the surfactant mixtures according to the invention contain components (a) and (b) in a ratio by weight of 0.1:1 to 1,000:1, preferably 1:1 to 100:1 and more particularly 5:1 to 20:1.

Nonionic Co-Surfactants

The surfactant mixtures according to the invention may also contain nonionic co-surfactants selected from the group consisting of alkyl and/or alkenyl oligoglycosides, alkoxylates of alkanols, end-capped alkoxylates of alkanols with no free OH groups, alkoxylated fatty acid lower alkyl esters, amine oxides, alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates (more particularly wheat-based vegetable products), polyol fatty acid esters, sugar esters, sorbitan esters and polysorbates. If the nonionic surfactants contain polyglycol ether chains, they may have a conventional homolog distribution although they preferably have a narrow homolog distribution.

Alkyl and/or Alkenyl Oligoglycosides

In another embodiment, the surfactant mixtures according to the invention contain alkyl and/or alkenyl oligoglycosides corresponding to formula (II):

$$R^5O\text{-}[G]_p \qquad \text{(II)}$$

in which $R^5$ is a $C_{4-22}$ alkyl and/or alkenyl group containing 4 to 22 carbon atoms, G is a sugar unit containing 5 or 6 carbon atoms and p is a number of 1 to 10. They may be obtained by the relevant methods of preparative organic chemistry. The synoptic articles by Biermann et al. in Starch/Stärke 45, 281 (1993), B. Salka in Cosm. Toil. 108, 89 (1993) and J. Kähre et al. in SÖFW-Journal, No. 8, 598 (1995) are cited as representative of the extensive literature available on the subject. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The alkyl group $R^5$ may be derived from primary saturated alcohols. Typical examples are butan-1-ol, caproic alcohol, oenanthic alcohol, caprylic alcohol, pelargonic alcohol, capric alcohol, undecan-1-ol, lauryl alcohol, tridecan-1-ol, myristyl alcohol, pentadecan-1-ol, cetyl alcohol, palmityl alcohol, heptadecan-1-ol, stearyl alcohol, isostearyl alcohol, nonadecan-1-ol, arachidyl alcohol, heneicosan-1-ol and behenyl alcohol and the technical mixtures thereof obtained, for example, in the hydrogenation of technical fatty acid methyl esters or in the hydrogenation of aldehydes from Roelen's oxo synthesis. The alkenyl group $R^5$ may be derived from primary unsaturated alcohols. Typical examples of unsaturated alcohols are undecen-1-ol, oleyl alcohol, elaidyl alcohol, ricinolyl alcohol, linoleyl alcohol, linolenyl alcohol, gadoleyl alcohol, arachidonyl alcohol, erucyl alcohol, brassidyl alcohol, palmitoleyl alcohol, petroselinyl alcohol, arachyl alcohol and the technical mixtures thereof obtainable in the manner described above. Alkyl or alkenyl groups $R^5$ derived from primary $C_{6-16}$ alcohols are preferred. Alkyl oligoglucosides having a chain length of $C_8$ to $C_{10}$, which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols are preferred. In addition, the alkyl or alkenyl group $R^5$ may also be derived from primary alcohols containing 12 to 14 carbon atoms.

The index p in general formula (II) indicates the degree of oligomerization (DP), i.e. the distribution of mono- and oligoglycosides, and is a number of 1 to 10. Whereas p in a given compound must always be an integer and, above all, may assume a value of 1 to 3, the value p for a certain alkyl oligoglycoside is an analytically determined calculated quantity which is generally a broken number. Alkyl and/or alkenyl oligoglycosides having an average degree of oligomerization p of 1.1 to 2.0 are preferably used. Alkyl and/or alkenyl oligoglycosides having a degree of oligomerization of less than 2.0 and, more particularly, between 1.2 and 1.7 are preferred from the applicational point of view. Alkyl and/or alkenyl oligoglycosides corresponding to formula (II), where p is a number of 1 to 3 and $R^5$ is a $C_{6-16}$ alkyl group, are preferably used.

Optionally End-Capped Alkoxylates of Alkanols

The other nonionic surfactants are preferably selected from the group consisting of alkoxylates of alkanols, more particularly fatty alcohol polyethylene glycol/polypropylene glycol ethers (FAEO/PO) corresponding to formula (III) or fatty alcohol polypropylene glycol/polyethylene glycol ethers (FAPO/EO) corresponding to formula (IV), end-capped alkoxylates of alkanols, more particularly end-capped fatty alcohol polyethylene glycol/polypropylene glycol ethers or end-capped fatty alcohol polypropylene glycol/polyethylene glycol ethers, and fatty acid lower alkyl esters and amine oxides.

Fatty Alcohol Polyethylene Glycol/Polypropylene Glycol Ethers

A preferred embodiment is characterized by the use of optionally end-capped fatty alcohol polyethylene glycol/polypropylene glycol ethers corresponding to formula (III):

$$R^6O(CH_2CH_2O)_n[CH_2(CH_3)CHO]_mR^7 \qquad \text{(III)}$$

in which $R^6$ is an alkyl and/or alkenyl group containing 8 to 22 carbon atoms, $R^7$ is H or an alkyl group containing 1 to 8 carbon atoms, n is a number of 1 to 40, preferably 1 to 30 and more particularly 1 to 15 and m is 0 or a number of 1 to 10.

Fatty Alcohol Polypropylene Glycol/Polyethylene Glycol Ethers

Optionally end-capped fatty alcohol polypropylene glycol/polyethylene glycol ethers corresponding to formula (IV):

$$R^8O[CH_2(CH_3)CHO]_q(CH_2CH_2O)_rR^9 \quad (IV)$$

in which $R^8$ is an alkyl and/or alkenyl group containing 8 to 22 carbon atoms, $R^9$ is H or an alkyl group containing 1 to 8 carbon atoms, q is a number of 1 to 5 and r is a number of 0 to 15. In another preferred embodiment, the surfactant mixture according to the invention contain fatty alcohol polyethylene glycol/polypropylene glycol ethers corresponding to formula (III) in which $R^6$ is an aliphatic saturated, linear or branched alkyl group containing 8 to 16 carbon atoms, n is a number of 1 to 10, m is 0 and $R^7$ is hydrogen. These compounds (III) are products of the addition of 1 to 10 mol ethylene oxide onto monohydric alcohols. Suitable alcohols are the above-described alcohols, such as fatty alcohols, oxo alcohols and Guerbet alcohols. Other suitable alcohol ethoxylates are those which have a narrow homolog distribution.

Other suitable representatives of non-end-capped representatives are those corresponding to formula (III) in which $R^6$ is an aliphatic, saturated, linear or branched alkyl group containing 8 to 16 carbon atoms, n is a number of 2 to 7, m is a number of 3 to 7 and $R^7$ is hydrogen. These compounds (III) are products of the addition of monohydric alcohols of the type already described alkoxylated first with 2 to 7 mol ethylene oxide and then with 3 to 7 mol propylene oxide. The end-capped compounds of formula (III) are terminated by a $C_{1-8}$ alkyl group ($R^7$). In the literature, such compounds are also commonly referred to as mixed ethers. Suitable representatives are methyl-group-terminated compounds of formula (III) in which $R^6$ is an aliphatic, saturated, linear or branched alkyl group containing 8 to 16 carbon atoms, n is a number of 2 to 7, m is a number of 3 to 7 and $R^7$ is a methyl group. Compounds such as these may readily be prepared by reacting the corresponding non-end-capped fatty alcohol polyethylene glycol/polypropylene glycol ethers with methyl chloride in the presence of a base. Suitable representatives of alkyl-group-terminated compounds are those of formula (III), in which $R^6$ is an aliphatic, saturated, linear or branched alkyl group containing 8 to 16 carbon atoms, n is a number of 5 to 15, m is 0 and $R^7$ is an alkyl group containing 4 to 8 carbon atoms. The end capping is preferably carried out with a linear or branched butyl group by reacting the corresponding fatty alcohol polyethylene glycol ether with n-butyl chloride or with tert.butyl chloride in the presence of bases.

Optionally end-capped fatty alcohol polypropylene glycol/polyethylene glycol ethers of formula (IV) may be present instead of or in admixture with the compounds of formula (III). Compounds such as these are described, for example, in DE-A1-4323252. Particularly preferred representatives of the compounds of formula (IV) are those in which $R^8$ is an aliphatic, saturated, linear or branched alkyl group containing 8 to 16 carbon atoms, q is a number of 1 to 5, r is a number of 1 to 6 and $R^9$ is hydrogen. Compounds such as these are preferably products of the addition of 1 to 5 mol propylene oxide and 1 to 6 mol ethylene oxide onto monohydric alcohols which have already been described as suitable in connection with the hydroxy mixed ethers.

Alkoxylated Fatty Acid Lower Alkyl Esters

Suitable alkoxylated fatty acid lower alkyl esters are surfactants corresponding to formula (V):

$$R^{10}CO—(OCH_2CHR^{11})_wOR^{12} \quad (V)$$

in which $R^{10}CO$ is a linear or branched, saturated and/or unsaturated acyl group containing 6 to 22 carbon atoms, $R^{11}$ is hydrogen or methyl, $R^{12}$ represents linear or branched alkyl groups containing 1 to 4 carbon atoms and w is a number of 1 to 20. Typical examples are the formal insertion products of on average 1 to 20 and preferably 5 to 10 mol ethylene and/or propylene oxide into the methyl, ethyl, propyl, isopropyl, butyl and tert.butyl esters of caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. Normally, the products are obtained by insertion of the alkoxides into the carbonyl ester bond in the presence of special catalysts such as, for example, calcined hydrotalcite. Reaction products of on average 5 to 10 mol ethylene oxide into the ester bond of technical coconut fatty acid methyl esters are particularly preferred.

Amine Oxides

Compounds corresponding to formula (VI) and/or (VII):

(VI)

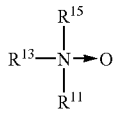

(VII)

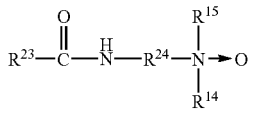

may be used as amine oxides. The amine oxides corresponding to formula (VI) are produced by oxidation of tertiary fatty amines having an least one long alkyl chain in the presence of hydrogen peroxide. In the amine oxides of formula (VI) suitable for the purposes of the invention, $R^{13}$ is a linear or branched alkyl chain containing 6 to 22 and preferably 12 to 18 carbon atoms and $R^{14}$ and $R^{15}$ independently of one another have the same meaning as $R^{13}$ or represent an optionally hydroxysubstituted alkyl group containing 1 to 4 carbon atoms. Preferred amine oxides of formula (VI) are those in which $R^{13}$ and $R^{14}$ represent $C_{12/14}$ or $C_{12/18}$ coconut alkyl groups and $R^{15}$ is a methyl or hydroxyethyl group. Other preferred amine oxides of formula (VI) are those in which $R^{13}$ is a $C_{12/14}$ or $C_{12/18}$ coconut alkyl group and $R^{14}$ and $R^{15}$ represent a methyl or hydroxyethyl group. Other suitable amine oxides are alkylamidoamine oxides corresponding to formula (VII) where the alkylamido group $R^{23}CONH$ is formed by the reaction of linear or branched carboxylic acids preferably containing 6 to 22 and more particularly 12 to 18 carbon atoms, more particularly from $C_{12/14}$ or $C_{12/18}$ fatty acids, with amines. $R^{24}$ is a linear or branched alkenyl group containing 2 to 6 and preferably 2 to 4 carbon atoms and $R^{14}$ and $R^{15}$ are as defined for formula (VI).

Other nonionic surfactants which may be used include alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates (more particularly wheat-based vegetable products), polyol fatty acid esters, sugar esters, sorbitan esters and polysorbates.

Anionic Co-Surfactants

Typical examples of anionic co-surfactants are soaps, alkyl benzenesulfonates, secondary alkane sulfonates, olefin sulfonates, alkyl ether sulfonates, glycerol ether sulfonates, α-methyl ester sulfonates, sulfofatty acids, alkyl and/or alkenyl sulfates, alkyl ether sulfates, glycerol ether sulfates, hydroxy mixed ether sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acylamino acids such as, for example, acyl lactylates, acyl tartrates, acyl glutamates and acyl aspartates, alkyl oligoglucoside sulfates, protein fatty acid condensates (particularly wheat-based vegetable products) and alkyl (ether) phosphates. If the anionic surfactants contain polyglycol ether chains, the polyglycol ether chains may have a conventional homolog distribution, although they preferably have a narrow homolog distribution. In a preferred embodiment, the surfactant mixtures may contain anionic surfactants selected from the group consisting of alkyl and/or alkenyl sulfates, alkyl ether sulfates, alkyl benzenesulfonates, monoglyceride (ether) sulfates and alkanesulfonates, more particularly fatty alcohol sulfates, fatty alcohol ether sulfates, secondary alkanesulfonates and linear alkyl benzenesulfonates.

Alkyl and/or Alkenyl Sulfates

Alkyl and/or alkenyl sulfates, which are often also referred to as fatty alcohol sulfates, are understood to be the sulfation products of primary alcohols which correspond to formula (VIII):

$$R^{16}O—SO_3X \quad (VIII)$$

in which $R^{16}$ is a linear or branched, aliphatic alkyl and/or alkenyl group containing 6 to 22 carbon atoms and preferably 12 to 18 carbon atoms and X is an alkali metal and/or alkaline earth metal, ammonium, alkyl ammonium, alkanolammonium or glucammonium. Typical examples of alkyl sulfates which may be used in accordance with the invention are the sulfation products of caproic alcohol, caprylic alcohol, capric alcohol, 2-ethyl hexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and the technical mixtures thereof obtained by high-pressure hydrogenation of technical methyl ester fractions or aldehydes from Roelen's oxo synthesis. The sulfation products may advantageously be used in the form of their alkali metal salts and particularly their sodium salts. Alkyl sulfates based on $C_{16/18}$ tallow fatty alcohols or vegetable fatty alcohols of comparable C chain distribution in the form of their sodium salts are particularly preferred.

Alkyl Ether Sulfates

Alkyl ether sulfates ("ether sulfates") are known anionic surfactants which, on an industrial scale, are produced by $SO_3$ or chlorosulfonic acid (CSA) sulfation of fatty alcohol or oxoalcohol polyglycol ethers and subsequent neutralization. Ether sulfates suitable for use in accordance with the invention correspond to formula (IX):

$$R^{17}O—(CH_2CH_2O)_aSO_3X \quad (IX)$$

in which $R^{17}$ is a linear or branched alkyl and/or alkenyl group containing 6 to 22 carbon atoms, a is a number of 1 to 10 and X is an alkali metal and/or alkaline earth metal, ammonium, alkylammonium, alkanolammonium or glucammonium. Typical examples are the sulfates of addition products of on average 1 to 10 and more particularly 2 to 5 moles of ethylene oxide onto caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium and/or magnesium salts. The ether sulfates may have both a conventional homolog distribution and a narrow homolog distribution. It is particularly preferred to use ether sulfates based on adducts of on average 2 to 3 mol ethylene oxide with technical $C_{12/14}$ or $C_{12/18}$ coconut fatty alcohol fractions in the form of their sodium and/or magnesium salts.

Alkyl Benzenesulfonates

Alkyl benzenesulfonates preferably correspond to formula (X):

$$R^{18}\text{-Ph-}SO_3X \quad (X)$$

in which $R^{18}$ is a branched, but preferably linear alkyl group containing 10 to 18 carbon atoms, Ph is a phenyl group and X is an alkali metal and/or alkaline earth metal, ammonium, alkyl ammonium, alkanolammonium or glucammonium. Dodecyl benzenesulfonates, tetradecyl benzenesulfonates, hexadecyl benzenesulfonates and technical mixtures thereof in the form of the sodium salts are preferably used.

Monoglyceride (Ether)sulfates

Monoglyceride sulfates and monoglyceride ether sulfates are known anionic surfactants which may be obtained by the relevant methods of preparative organic chemistry. They are normally produced from triglycerides by transesterification to the monoglycerides, optionally after ethoxylation, followed by sulfation and neutralization. The partial glycerides may also be reacted with suitable sulfating agents, preferably gaseous sulfur trioxide or chlorosulfonic acid [cf. EP 0561825 B1, EP 0561999 B1 (Henkel)]. If desired, the neutralized products may be subjected to ultrafiltration to reduce the electrolyte content to a desired level [DE 4204700 A1 (Henkel)]. Overviews of the chemistry of monoglyceride sulfates have been published, for example, by A. K. Biswas et al. in J. Am. Oil Chem. Soc. 37, 171 (1960) and by F. U. Ahmed in J. Am. Oil Chem. Soc. 67, 8

(1990). The monoglyceride (ether)sulfates suitable for the purposes of the invention correspond to formula (XI):

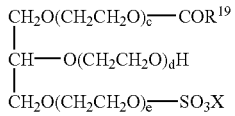

(XI)

in which $R^{19}CO$ is a linear or branched acyl group containing 6 to 22 carbon atoms, c, d and e together stand for 0 or numbers of 1 to 30 and preferably 2 to 10 and X is an alkali metal or alkaline earth metal. Typical examples of monoglyceride (ether)sulfates suitable for the purposes of the invention are the reaction products of lauric acid monoglyceride, coconut fatty acid monoglyceride, palmitic acid monoglyceride, stearic acid monoglyceride, oleic acid monoglyceride and tallow fatty acid monoglyceride and ethylene oxide adducts thereof with sulfur trioxide or chlorosulfonic acid in the form of their sodium salts. Monoglyceride sulfates corresponding to formula (XI), in which $R^{19}$ CO is a linear acyl group containing 8 to 18 carbon atoms, are preferably used.

Alkanesulfonates

Alkane sulfonates are understood to be compounds corresponding to formula (XII):

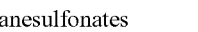

(XII)

where $R^{20}$ and $R^{21}$ are alkyl groups, with the proviso that $R^{20}$ and $R^{21}$ together contain no more than 50 carbon atoms. In a preferred embodiment, the invention relates to nonaqueous surfactant mixtures which may optionally contain nonaqueous solubilizers. These solubilizers are described hereinafter under the heading "Auxiliaries". "Nonaqueous surfactant mixtures" are understood to be mixtures with a water content of or below 5% by weight.

Cleaning Compositions

The present invention also relates to compositions for cleaning hard surfaces which contain the surfactant mixtures according to the invention of hydroxy mixed ethers and polymers, the compositions containing in all 0.01 to 60% by weight, preferably 0.1 to 15% by weight and more particularly 0.5 to 12% by weight of surfactants and 0.01 to 10% by weight, preferably 0.1 to 8% by weight and more particularly 0.2 to 7% by weight of polymers. In a particularly preferred embodiment, the percentage content of surfactants with no hydroxy mixed ethers of formula (I) is between 0 and 85% by weight, preferably between 1 and 50% by weight and more particularly between 10 and 30% by weight. In one particular embodiment, the compositions according to the invention contain 5 to 90% by weight, preferably 10 to 80% by weight of builders, 0.1 to 7% by weight of enzyme, 0.1 to 40% by weight and preferably 0.5 to 30% by weight of bleaching agent and optionally other auxiliaries. These percentages by weight (% by weight) are based on the composition as a whole.

Auxiliaries and Additives

The compositions according to the invention may contain, for example, solubilizers, such as cumenesulfonate, ethanol, isopropyl alcohol, ethylene glycol, propylene glycol, butyl glycol, diethylene glycol, propylene glycol monobutyl ether, polyethylene or polypropylene glycol ether with molecular weights of 600 to 1,500,000 and preferably in the range from 400,000 to 800,000 or, more particularly, butyl diglycol as auxiliaries. In many cases, an additional bactericidal effect is required so that the compositions may contain cationic surfactants or biocides, for example glucoprotamine.

Suitable builders are zeolites, layer silicates, phosphates and ethylenediamine tetraacetic acid, nitrilotriacetic acid, citric acid and salts thereof and inorganic phosphonic acids.

Among the compounds acting as peroxy bleaching agents, sodium perborate tetrahydrate and sodium perborate monohydrate are particularly important. Other bleaching agents are, for example, peroxycarbonate, citrate perhydrates and $H_2O_2$-yielding peracidic salts of the per acids, such as perbenzoates, peroxyphthalates or diperoxydodecanedioic acid. They are normally used in quantities of 0.1 to 40% by weight. Sodium perborate monohydrate in quantities of 10 to 20% by weight and more particularly 10 to 15% by weight is preferably used.

Suitable enzymes are those from the class of proteases, lipases, amylases, cellulases or mixtures thereof. Enzymes obtained from bacterial strains or fungi, such as *Bacillus subtilis, Bacillus licheniformis* and *Streptomyces griseus* are particularly suitable. Proteases of the subtilisin type, particularly proteases obtained from *Bacillus lentus*, are preferably used. The percentage content of enzymes may be from about 0.1 to 7% by weight and is preferably from 0.2 to 2% by weight. The enzymes may be adsorbed onto carriers or encapsulated in membrane materials to protect them against premature decomposition.

In addition to mono- and polyhydric alcohols and phosphonates, the compositions may contain other enzyme stabilizers. For example, 0.5 to 1% by weight sodium formate may be used. Proteases stabilized with soluble calcium salts which have a calcium content of preferably about 1.2% by weight, based on the enzyme, may also be used. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

Where the compositions are used in machine cleaning processes, it can be of advantage to add typical foam inhibitors to them. Suitable foam inhibitors contain, for example, known organopolysiloxanes and/or paraffins or waxes. The compositions may also contain foam regulators, for example soap, fatty acids, more particularly coconut oil fatty acid and palm kernel oil fatty acid.

Suitable thickeners are, for example, hydrogenated castor oil, salts of long-chain fatty acids which are preferably used in quantities of 0 to 5% by weight and more particularly in quantities of 0.5 to 2% by weight, for example sodium, potassium, aluminium, magnesium and titanium stearates or the sodium and/or potassium salts of behenic acid and other polymeric compounds. These other polymeric compounds are preferably polyvinyl pyrrolidone, urethanes and the salts of polymeric polycarboxylates, for example homopolymeric or copolymeric polyacrylates, polymethacrylates and in particular copolymers of acrylic acid with maleic acid, preferably those of 50 to 10% by weight maleic acid. The relative molecular weight of the homopolymers is generally in the range from 1,000 to 100,000 and that of the copolymers in the range from 2,000 to 200,000 and preferably in the range from 50,000 to 120,000, based on the free acid. Water-soluble polyacrylates crosslinked, for example, with about 1% of a polyallyl ether of sucrose and having a molecular weight above 1,000,000 are also particularly suitable. Examples include the polymers obtainable under the name of Carbopol® 940 and 941. The crosslinked polyacrylates are preferably used in quantities of not more than 1% by weight and more particularly in quantities of 0.2 to 0.7% by weight.

The compositions according to the invention are particularly preferred for cleaning hard surfaces which are solid at room temperature. These compositions are preferably made up as granules, powders or shaped bodies, such as tablets, bars or balls. In a particularly preferred embodiment, the compositions according to the invention contain at most 10% by weight, preferably 1 to 5% by weight and more particularly 2 to 4% by weight of water.

In another preferred embodiment, the invention relates to water-based compositions for cleaning hard surfaces with a pH of or below 7 which are characterized in that they contain the surfactant mixtures according to the invention. Water-based compositions in the form of rinse agents for dishwashing machines are a particularly preferred variant of this embodiment.

Commercial Applications

The present invention also relates to the use of the surfactant mixtures according to the invention in laundry detergents, dishwashing detergents and cleaning compositions and for the production of cleaning solutions with improved performance against the resoiling of hard surfaces. The surfaces are left with such a finish that soil is easier to remove in the next cleaning cycle. The effect of adding polymers to rinse agents, for example, is that otherwise firmly adhering, often critical soils, for example starch-containing soils, can be completely removed in the next cleaning cycle without any need for manual treatment (for example prerinsing) beforehand.

The washing and cleaning of hard surfaces in the home and in the industrial and institutional sector is particularly preferred. The surfactant mixtures according to the invention are particularly suitable for use in dishwashing detergents, rinse agents, bathroom cleaners, floor cleaners, so-called clean shower cleaners (for example bathroom cleaners which are sprayed onto walls and fittings before and after showering so that the water and soap residues drain off better so that no wiping is necessary and the surfaces are better protected against resoiling), cockpit cleaners (cars, aircraft, ships, motorbikes), window cleaners and all-purpose cleaners. Hard surfaces are inter alia ceramic surfaces, metal surfaces, painted surfaces, plastic surfaces and surfaces of glass, stone, concrete, china and wood.

The use of the surfactant mixtures according to the invention is particularly preferred for improving wetting behavior in dishwashing detergents and cleaners, preferably on hard surfaces, more particularly in dishwasher detergents and/or rinse agents.

The use of the surfactant mixtures according to the invention is also preferred for improving compatibility with plastics in dishwashing detergents and cleaners, more particularly in dishwasher detergents and/or rinse agents.

In another preferred embodiment, the hydroxy mixed ethers corresponding to formula (I) are used in combination with alkyl and/or alkenyl oligoglycosides in the cleaning sectors mentioned in the foregoing.

The surfactant mixtures according to the invention, optionally in combination with the other surfactants already described, are most particularly preferred for the simplified production of solid cleaning formulations. By virtue of their relatively high melting points, the hydroxy mixed ethers according to the invention are easier to incorporate in dishwashing and cleaning formulations, more particularly in solid cleaners.

EXAMPLES

Screening Method for Evaluating the Wetting

Properties of Surfactant Solutions on Plastics:

The wetting properties of surfactant solutions on plastics were determined in a simplified screening test under the conditions/test parameters in a commercially available dishwasher, but without actually using one.

To evaluate the wetting properties, plastic test specimens measuring 20×5 cm are cleaned first with 1% NaOH and then with isopropanol. The test specimens thus pretreated are then immersed in the solution to be tested and immediately withdrawn again. Evaluation is carried out visually by drawing up a ranking list or on a scoring scale of 1 to 5 where a score of 5 means that the liquid film breaks up spontaneously and the wetting effect is completely eliminated. A score of 5 is obtained where water is used. A score of 1 signifies complete wetting of the plastic surface and uniform drainage of the liquid film. A score of 1 is obtained where Na-LAS (for example Maranil A55® COGNIS) is used.

Test Parameter:

| | |
|---|---|
| Water hardness: | 2° d |
| Salt content: | 700 ppm |
| Temperature: | 60° C. |
| Surfactant concentration: | 0.1% (active substance) |

Test Specimens:

PP (polypropylene); PE (polyethylene); PC (polycarbonate)

The test results are set out in Table 1 where C1 to C3 are Comparison Examples and 1 to 5 are the Examples according to the invention.

TABLE 1

| | Active substance shown in % by weight | | | | | | | | |
|---|---|---|---|---|---|---|---|---|---|
| | C1 | C2 | C3 | 1 | 2 | 3 | 4 | 5 | 6 |
| HME 1 | | 15.0 | | 13.0 | | 13.0 | 13.0 | 13.0 | 13.0 |
| HME 2 | | | 15.0 | | 13.0 | | | | |
| Polymer 1 | | | | 2.0 | 2.0 | | | | |
| Polymer 2 | | | | | | 2.0 | | | |
| Polymer 3 | | | | | | | 2.0 | | |
| Polymer 4 | | | | | | | | 2.0 | |
| Polymer 5 | | | | | | | | | 2.0 |
| Cumenesulfonate | 3.0 | 3.0 | 3.0 | 3.0 | 3.0 | 3.0 | 3.0 | 3.0 | 3.0 |
| Citric acid | 5.0 | 5.0 | 5.0 | 5.0 | 5.0 | 5.0 | 5.0 | 5.0 | 5.0 |
| Water | | | | | to 100 | | | | |
| pH | | | | | 1–2 | | | | |
| Appearance at 70° C. | Clear | Clear | Clear | Clear | Clear | Clear | Clear | Clear | Clear |
| Wetting properties | | | | | | | | | |
| PP | 5 | 4 | 3 | 2 | 1 | 2 | 2 | 3 | 2 |
| PE | 5 | 4 | 4 | 2 | 2 | 3 | 3 | 3 | 2 |
| PC | 5 | 3 | 3 | 1 | 1 | 2 | 2 | 2 | 2 |

HME 1: C8/10-[PO]1-[EO]22-C10

HME 2: C8/10-[EO]40-C12

Polymer 1: trimethyl ammonium propyl methacrylamide sodium acrylate ethyl acrylate polymer—Polyquart Ampho 149® Cognis Polymer 2: polyacrylic acid copolymer—Versicol E 11® Allied Colloids Polymer 3: terephthalic acid ethylene glycol polyethylene glycol polyester—Velvetol 251 C® Rhone Poulenc Polymer 4: polyacrylamidopropane sulfonic acid—Rheothik 80-11® Cognis Polymer 5: protein hydrolyzate, quaternized—Gluadin WQ® Cognis It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A surfactant mixture comprising: (a) one or more hydroxy mixed ethers of the formula:

$$R^1O—[CH_2CH(CH_3)O]_x[CH_2CH(R^2)O]_yCH_2CH(OH)R^3 \quad (I)$$

wherein $R^1$ represents an alk(en)yl group having from 4 to 22 carbon atoms, each $R^2$ independently represents a hydrogen, a methyl or an ethyl group, $R^3$ represents an alk(en)yl group having from 4 to 22 carbon atoms, x is a number of from 0 to 60, y is a number of from 1 to 80, wherein the $[CH_2CH(CH_3)O]_x[CH_2CH(R^2)O]_y$ portion of the formula (I) represents blocked and/or randomized alkoxylation; and (b) at least one polymer comprising a cationic polymer comprising residues of a monomer unit of the formula:

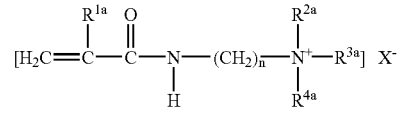

(Ia)

wherein n represents a number of from 2 to 4, $R^{1a}$ represents a hydrogen or a methyl group and $R^{2a}$, $R^{3a}$ and $R^{4a}$ each independently represent a hydrogen or a $C_{1-4}$ alk(en)yl group, $X^-$ represents an anion selected from the group consisting of halide anions and monoalkyl anions of sulfuric acid semiester.

2. The surfactant mixture according to claim 1, wherein x is equal to 0 and y represents a number of from 20 to 60.

3. The surfactant mixture according to claim 1, wherein $R^1$ represents a linear alk(en)yl group having from 4 to 22 carbon atoms.

4. The surfactant mixture according to claim 1 wherein components (a) and (b) are present in a ratio by weight of from 0.1:1 to 1,000:1.

5. The surfactant mixture according to claim 1, further comprising a nonionic surfactant selected from the group consisting of aikyl and/or alkenyl oligoglycosides, alkoxylates of aikanols, end-capped alkoxylates of alkanols with no free OH groups, alkoxylated fatty acid lower alkyl esters, amine oxides, alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates, polyol fatty acid esters, sugar esters, sorbitan esters and polysorbates.

6. The surfactant mixture according to claim 1, further comprising an anionic surfactant selected from the group consisting of alkyl and/or alkenyl sulfates, alkyl ether sulfates, alkyl benzenesulfonates, monoglyceride(ether)sulfates and alkanesulfonates.

7. The surfactant mixture according to claim 1, wherein the mixture is in a nonaqueous form.

8. A composition for cleaning hard surfaces, the composition comprising the surfactant mixture according to claim 1, wherein the one or more hydroxy mixed ethers are present in an amount of from 0.01 to 60% by weight, and the at least one polymer is present in an amount of from 0.01 to 10% by weight.

9. The composition according to claim 8, further comprising up to 85% by weight of an additional surfactant.

10. The composition according to claim 8, further comprising from 5 to 90% by weight of a builder, from 0.1 to 7% by weight of an enzyme, and from 0.1 to 40% by weight of a bleaching agent.

11. The composition according to claim 8, wherein the composition is solid at room temperature.

12. The composition according to claim 8, further comprising up to 10% by weight water.

13. A water-based composition having a pH of 7 or less, wherein the composition comprises the surfactant mixture according to claim 1.

14. A method for improving the wetting behavior of a dishwashing detergent composition, said method comprising:

(a) providing a surfactant mixture comprising: (i) one or more hydroxy mixed ethers of the formula:

$$R^1O—[CH_2CH(CH_3)O]_x[CH_2CH(R^2)O]_y—CH_2CH(OH)R^3 \quad (I)$$

wherein $R^1$ represents an alk(en)yl group having from 4 to 22 carbon atoms, each $R^2$ independently represents a hydrogen, a methyl or an ethyl group, $R^3$ represents an alk(en)yl group having from 4 to 22 carbon atoms, x is a number of from 0 to 60, y is a number of from 1 to 80, wherein the $[CH_2CH(CH_3)O]_x[CH_2CH(R^2)O]_y$ portion of the general formula (I) represents blocked and/or randomized alkoxylation; and (ii) at least one polymer comprising a cationic polymer comprising residues of a monomer unit of the formula:

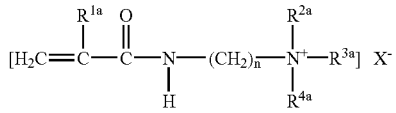

(Ia)

wherein n represents a number of from 2 to 4, $R^{1a}$ represents a hydrogen or a methyl group and $R^{2a}$, $R^{3a}$ and $R^{4a}$ each independently represent a hydrogen or a $C_{1-4}$ alk(en)yl group, $X^-$ represents an anion selected from the group consisting of halide anions and monoalkyl anions of sulfuric acid semiester; and (b) combining the surfactant mixture and one or more detergent additives or auxiliaries.

15. A surfactant mixture comprising: (a) one or more hydroxy mixed ethers of the formula;

$$R^1O—[CH_2CH(CH_3)O]_x[CH_2CH(R^2)O]_yCH_2CH(OH)R^3 \quad (I)$$

wherein $R^1$ represents an alk(en)yl group having from 4 to 22 carbon atoms, each $R^2$ independently represents a hydrogen, a methyl or an ethyl group, $R^3$ represents an alk(en)yl group having from 4 to 22 carbon atoms, x is a number of from 0 to 60, y is a number of from 1 to 80, wherein the $[CH_2CH(CH_3)O]_x[CH_2CH(R^2)O]_y$ portion of the formula (I) represents blocked and/or randomized alkoxylation; and (b) at least one polymer comprising a cationic polymer selected from the group consisting of polymers or copolymers of trialkylammonium alkyl (meth)acrylate copolymers of acrylamide, polymer or copolymers of dialkyldiallyl diammonium salts, polymer analog reaction products of ethers or esters of polysaccharides containing ammonium side groups, guar, cellulose and starch derivatives, polyadducts of ethylene oxide with ammonium groups, polyesters and polyamides containing quaternary side groups.

16. The surfactant mixture of claim 1 wherein the cationic polymer contains from 10 mol % to 80 mol % of residues of the monomer (1a).

17. The surfactant mixture of claim 16 wherein the cationic polymer contains from 20 mol % to 60 mol % of residues of the monomer (1a).

* * * * *